United States Patent [19]

Schaefer et al.

[11] Patent Number: 4,726,087

[45] Date of Patent: Feb. 23, 1988

[54] CONTOURED-HEAD AND NECK FOAM PILLOW

[75] Inventors: Daniel J. Schaefer, Greenville; John K. Luke, Greer, both of S.C.

[73] Assignee: Span-America Medical Systems, Inc., Greenville, S.C.

[21] Appl. No.: 899,535

[22] Filed: Aug. 22, 1986

[51] Int. Cl.[4] ..... A47C 20/00

[52] U.S. Cl. ..... 5/434; 5/435; 5/446; 5/464; 5/481

[58] Field of Search ..... 5/436, 434, 481, 435, 5/431, 446, 468, 464, 465, 437; 297/DIG. 1

[56] References Cited

U.S. PATENT DOCUMENTS

| | | | |
|---|---|---|---|
| D. 276,938 | 12/1984 | Pedersen | D24/36 |
| 1,312,886 | 8/1919 | Bawden . | |
| 2,305,173 | 12/1942 | Leeb | 5/438 |
| 2,674,752 | 4/1954 | Berman | 5/434 |
| 2,880,428 | 4/1959 | Forsland | 5/337 |
| 3,047,282 | 7/1962 | Hardy | 5/481 X |
| 3,239,854 | 3/1966 | Freedlander | 5/434 |
| 3,319,272 | 5/1967 | Eller . | |
| 3,400,413 | 9/1968 | La Grossa . | |
| 3,434,715 | 3/1969 | Brantingham et al. | 5/417 X |
| 3,521,310 | 7/1970 | Greenawalt | 5/436 |
| 3,529,306 | 9/1970 | Thorne | 297/DIG. 1 |
| 3,602,928 | 9/1971 | Helzer . | |
| 3,753,264 | 8/1973 | Grenier . | |
| 3,829,917 | 8/1974 | De Laittre | 5/436 |
| 3,851,347 | 12/1974 | Ashley | 5/338 |
| 3,885,257 | 5/1975 | Rogers | 5/464 |
| 3,974,532 | 8/1976 | Ecchuya | 5/481 X |
| 4,070,719 | 1/1978 | Morgan | 5/355 |
| 4,110,881 | 9/1978 | Thompson | 5/481 X |
| 4,147,825 | 4/1979 | Talalay | 418/138 |
| 4,207,636 | 6/1980 | Ceriani | 5/434 X |
| 4,218,792 | 8/1980 | Kogan | 5/436 |
| 4,320,543 | 3/1982 | Dixon | 5/434 |
| 4,383,342 | 5/1983 | Forster | 5/432 |
| 4,399,574 | 8/1983 | Shuman | 5/431 X |
| 4,524,473 | 6/1985 | Fanti | 5/481 |
| 4,573,456 | 3/1986 | Spann | 128/80 R |
| 4,603,445 | 8/1986 | Spann | 5/468 X |
| 4,620,337 | 11/1986 | Williams et al. | 5/481 X |

FOREIGN PATENT DOCUMENTS

| | | | |
|---|---|---|---|
| 569690 | 8/1958 | Belgium | 5/481 |
| 1554105 | 11/1969 | Fed. Rep. of Germany | 5/481 |
| 1120734 | 1/1955 | France . | |
| 1099929 | 9/1955 | France | 5/481 |
| 2504795 | 11/1982 | France | 5/436 |
| 526407 | 5/1955 | Italy | 5/481 |
| 2084867 | 4/1982 | United Kingdom | 5/481 |

OTHER PUBLICATIONS

Pro Tech Pacific, *The ProPillow*, 1981.

*Primary Examiner*—Gary L. Smith
*Assistant Examiner*—Carl M. DeFranco, Jr.
*Attorney, Agent, or Firm*—Dority & Manning

[57] ABSTRACT

A foam pillow has two main support surfaces on opposing sides thereof. One surface includes convolutions defining a relatively flat profile and the other surface includes longitudinal ribs of arcuate cross-section, which define a curved profile having at least two prominent lobes of differing heights and a central trough. The pillow is particularly adapted for support of a person's head in the trough, with the user's neck received on one of the lobes. Reversal of the lobes permits variation in the amount of neck support. The ribs comprise spherical ridges and have circular channels separating their bases to provide a heat and moisture dissipation function. The curved support surface may include cross-hatching at various intervals to provide extra dispersion of pressure.

12 Claims, 4 Drawing Figures

CONTOURED-HEAD AND NECK FOAM PILLOW

BACKGROUND OF THE PRESENT INVENTION

This invention concerns pillows in general, and in particular a foam pillow, with certain longitudinal characteristics and reversible and invertible features, adapted for selective support of a user's head and neck.

Due to the physical attributes of a typical person, the neck of a person reclining in a horizontal position (and without any particular pillow support or the like) becomes an unsupported bridge between their shoulders and their head. Such is generally true whether an individual is lying on their back or their side. Without proper head and neck support, muscle strain (particularly in the neck region) is not uncommon. Such strain leads to discomfort and restlessness which can defeat the entire purpose of a person's rest or sleep period.

During rest, individuals commonly recline in a relatively horizontal position with their head and part of their neck variously supported on pillows. Many commercial pillows for either home or hospital use comprise generally rectangular constructions with tapered edges, and are filled with a variety of cushioning materials, such as foam or down.

Often times, a person will "fluff" a pillow before using it. In effect, the pillow is being puffed up so that resting of one's head on the pillow will form a slight cradle, with other portions of the pillow being pushed outward to provide support for the user's neck. The desired affect is quickly lost once the pillow becomes pushed down again (i.e. "un-fluffed").

In general recognition of such head and neck support problems, it is known in the prior art to provide various contoured pillow arrangements (particularly for surgical or hospital patients) which differentially support a user's head and neck so that the naturally unsupported region beneath the neck is provided some support. For example, U.S. Pat. No. Des. 276,938 to Pedersen and French Pat. No. 1,120,734 by Cabrit et al. disclose contoured pillow designs having a profile including at least two raised areas as well as a trough for generally receiving a user's head. The person's head is retained in the trough between the two raised areas, with one of the raised areas supporting the neck region. Pedersen and Cabrit both disclose sloped regions adjacent one of the raised areas for also supporting upper shoulder regions; thus, they are intended for a single user orientation only, and do not vary the amount of neck support.

Similarly, Kogan (U.S. Pat. No. 4,218,792) concerns an orthopedic pillow having a cross-sectional profile with a trough for receiving a person's head, surrounded by two raised areas, one of which supports the user's neck region. A convex boss is provided on one side of the pillow for alignment under the nape of the user's neck; thus, Kogan has only one intended user orientation, and does not disclose structure to vary the amount of neck support.

While such references represent an advance in the area of supporting a person's head and neck over non-contoured support arrangements, they don't teach variations and modifications to provide selected elevations and positions for heads and necks of varying shapes and sizes. Dixon (U.S. Pat. No. 4,320,543) and De Laittre et al. (U.S. Pat. No. 3,829,917) disclose various medical and therapeutic contoured support pillows which include features for varying the amount of support of a user's head and neck.

Dixon discloses a pillow providing both vertical and lateral support for surgical purposes. Alternately matable members may be relatively rotated at 90° intervals with respect to each other, for varying the height of a trough through which a user's neck passes for support of the user's head in a roughly cup-shaped arrangement having a convoluted support surface. The pillow provides four-way support of a recumbent user's head to immobilize same for surgical or other medical reasons in a so-called neutral or "sniffing" position, for administering anesthetics or when a patient must undergo treatment in an intensive care unit.

De Laittre discloses a therapeutic pillow which is intended to be aesthetically appealing by providing the appearance of a conventional pillow. Two convex lobes emerge from an underside of the pillow, overhang edges thereof, and merge at a mutually-shared trough. The lobes have a relatively constant diameter from the underside support surface to the shared trough. All four corners of the generally rectangular pillow are pulled inwardly by receipt and support of a user's head centrally thereon. So supported, forces push in on the top of the user's head, while other forces present at the user's neck and bottom of the head push outward to pull and stretch the neck muscles. Such forces are achieved with the integral construction and unitary face of the De Laittre device, in combination with the overhanging convex lobes thereof, which are of different height to provide support for heads and necks of various shapes and sizes.

In general, the foregoing devices, while recognizing the need for selective differential support of a person's head and neck, are generally restrictive in terms of positioning of the head since they are directed to medical or therapeutic applications. Furthermore, they may cause unpleasant cradling forces on a user's head due to lack of independent action for the surface features thereof. All such restrictiveness and unpleasant sensations may be acceptable in the limited use categories of medical or therapeutic needs, but are strongly undesirable for the comfort sought during everyday use such as rest or sleep periods.

Furthermore, none of the foregoing exemplary references combine their concern for differential head and neck support with any particular features thereof directed to other aspects of extended user comfort, such as moisture and heat control. Dixon refers to some air circulation around his convolutions, but basically teaches that a user's head should be deeply cradled in a soft support surface to immobilize same. In fact, the rather restrictive cradling of a number of prior art devices, such as the devices of Kogan, De Laittre, and Dixon, can contribute to a build-up of heat and moisture around a user's head, instead of dissipating same.

Leeb (U.S. Pat. No. 2,305,173) discloses a generally rectangular headrest having vertical openings which extend perpendicularly from a headrest support surface to internal cavities where medicated vapor vessels are received. Vapors ascend such vertical channels to provide a user with relief from the discomfort of blocked breathing. Such channeling directs vapors towards the support surface, instead of providing dissipation for heat or moisture generated by a user's head and neck resting thereon.

Spann (U.S. Pat. No. 4,573,456) discloses foam body supports, such as a foot splint which surrounds an injured foot, which have a plurality of enlarged air channels parallel to the user's leg for ventilating the enclosed leg or foot. A seat comprising a flat block of foam is also shown with such enlarged air channels.

SUMMARY OF THE PRESENT INVENTION

The present invention recognizes and addresses many of the foregoing drawbacks, as well as others.

One object of the present invention is to provide a contoured pillow having features directed to differential support of a user's head and neck, and remaining relatively free of imposing any restrictions on further movement by the user.

A further object of the present invention is to provide a contoured pillow having features for differentially supporting a user's head and neck, but without applying any unpleasant forces or pressure on such user. Yet a further object of this invention is provision of a contoured pillow, having a plurality of longitudinal features which enable independent action of members defining such features, for reducing or minimizing any unpleasant forces or pressure applied to a user while differentially supporting the head and neck of same.

It is another object of the present invention to provide a construction which is reversible for varying the relative amounts of differential head and neck support to accommodate variety in head and neck sizes and shapes, with such construction also including further features in accordance with this invention.

Yet another object of this invention is to provide an invertible embodiment, comprising a generally rectangular construction having opposing, relatively planar sides, one of which is substantially flat and the other of which is provided with a predetermined curvature in accordance with other features of this invention. Such rectangular pillow may be inverted from one main planar side to another while still (in either orientation) providing selective, differential support of a user's head and neck.

Still another object of the present invention is to provide an improved pillow embodying a number of the foregoing objects and features of the present invention, while also providing dissipation characteristics for promoting the removal of heat and moisture from the head and neck of a user supported on such pillow. In one exemplary aspect, such dissipation may be achieved by parallel, longitudinal air channels disposed perpendicularly to a given orientation of a user's head and neck supported on such pillow, whereby heat and moisture is efficiently directed by such channels away from the user's head and neck.

In conjunction with such dissipation feature, it is a further object of this invention to provide functionally independent support ridges, associated in parallel with such dissipation channels, which promote enhanced dissipation at the periphery of a user's head and neck by differentially enlarging radial openings in such channels (thereby increasing the dissipation of heat and moisture through such channels by increasing the volume of airflow therethrough).

The foregoing objects and aspects of the present invention may be variously embodied in numerous features thereof, given collections of which may comprise an exemplary embodiment of a construction in accordance with features of the present invention. For present purposes of disclosing exemplary embodiments which are illustrative of (but not limitive to) this invention, various particular embodiments are set forth herewith.

One such exemplary embodiment includes a pillow for supporting a person's head and neck in a selected disposition, the pillow being constructed essentially of foam materials and comprising: a generally rectangular structure having longitudinal and lateral axes perpendicular to one another, and with the lateral axis being shorter than the longitudinal axis; an upper support surface defined on the structure and having longitudinal features forming a lateral profile, which profile includes two prominent lobes of differing heights and a relative trough therebetween; and a plurality of longitudinal ribs having arcuate cross-sections, formed in the upper support surface and defining the profile thereof.

Another exemplary construction in accordance with features of the present invention is directed to a construction of resilient material for use as a head pillow for a person, comprising: an integral member composed of the resilient material and having an upper support surface of a predetermined profile; a plurality of parallel, spherical ridges formed on the support surface and conforming to the profile thereof; and a plurality of parallel channels, defined by the upper support surface, and respectively interposed between adjacent of the ridges.

Yet another exemplary preferred embodiment incorporating features of the present invention includes a pillow for supporting the head and neck of a person situated in a generally horizontal position, the pillow comprising: a generally planar, rectangular body of resilient material, having two main support surfaces on opposing sides thereof and being invertible between two positions for providing direct support of the head and neck of a user on a selected one of the support surfaces of the body; scalloping in rows, with spherical air channels defined therebetween, disposed on a given one of the support surfaces; and convolutions defined on another one of the support surfaces. All modifications, variations, and equivalent substitutions for features and elements of the present invention which would occur to one of ordinary skill in the art are included aspects of this invention by virtue of present reference thereto.

BRIEF DESCRIPTION OF THE DRAWINGS

A full and enabling disclosure of the present invention, including the best mode thereof, may be understood upon studying the following specification in conjunction with the appended figures, in which.

Figure 1:
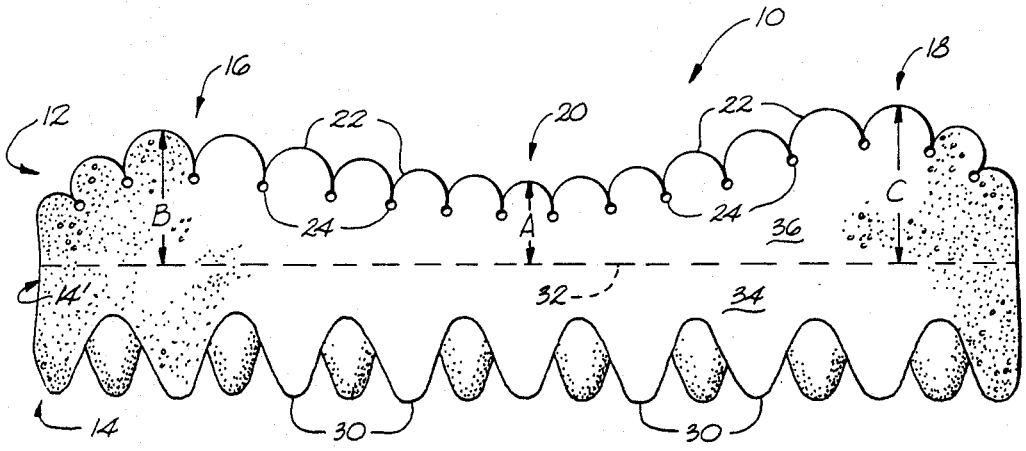
FIG. 1 illustrates an end view of an exemplary embodiment constructed in accordance with features of the present invention.

Repeat use of reference characters throughout the following specification and drawings is intended to indicate the same or analogous elements or features of the invention.

DETAILED DESCRIPTION OF THE PREFERRED EMBODIMENT

Referring to FIG. 1, an end view illustrates the lateral profile of an exemplary foam pillow 10 in accordance with features of the present invention. Pillow 10 includes two main support surfaces 12 and 14, having relatively curved and flat profiles, respectively. Pillow 10 may be inverted so that either surface 12 or 14 is upwardly disposed for receipt and support of a user's head and neck, but it is generally preferred that surface 12 defines an upper support surface, with two prominent lobes (or maximums) 16 and 18 and a relative trough (or minimum) 20 forming the predetermined curved profile thereof. Longitudinal, scalloped ribs 22 conform to such curved profile of upper support surface 12.

Ribs 22 comprise parallel, longitudinal projections extending from and along the main body of pillow 10. Ribs 22 have arcuate cross-sections, and thus comprise a plurality of parallel spherical ridges. Further longitudinal features of upper support surface 12 include a plurality of parallel, generally circular channels 24. Such channels are disposed between each pair of ribs 22, and are actually defined in upper surface 12 along with lower extensions of the radial surfaces of ribs 22. The radial surfaces of adjacent ribs are not joined, but instead are merely in contact with one another. Since pillow 10 is comprised of foam or foam-like material, ribs 22 may be pushed back and separated at any point along their longitudinal length to expose radial openings into circular channels 24. Even without such physical separation, air may diffuse through the porous foam material to reach channels 24. Beneficial effects of such diffusion are discussed in greater detail below, particularly with reference to FIG. 4.

In the generally preferred use of pillow 10 wherein surface 12 comprises an upper support surface, surface 14 comprises a lower support surface. Surface 14 includes a plurality of convolutions 30, which are themselves known in the art. The tips of convolutions 30 define a relatively flat profile for lower support surface 14.

While convolutions 30 and ribs 22 may be formed from one integral body of foam comprising pillow 10, they may also respectively be formed on surfaces of two separate bodies of foam 34 and 36, joined along dotted line 32. Such two separate members, defined by the indicated portions above and below dotted line 32, may be glued or otherwise attached to one another along dotted line 32 so as to collectively comprise the illustrated pillow 10.

Alternatively, as an optional feature of the present invention, a relatively flat lower support surface 14' may be provided for a given pillow 10 by using only upper member 36, without attaching lower portion 34. In such instance, the flat lower surface 14' of upper member 36 literally becomes the lower surface of pillow 10.

Various dimensions may be provided for a given construction in accordance with the present invention. While FIG. 1 is not intended as a scale drawing, the following dimensions are exemplary of a given construction. Lower portion 34 of pillow 10 may be about 5 centimeters thick (the distance from dotted line 32 to the tips of convolutions 30). Both lower portion 34 and upper portion 36 comprise rectangles of approximately 40 centimeters lateral width and 52 centimeters longitudinal length. Generally, this corresponds to a pillow size of 16×20 inches.

The thickness of upper portion 36 varies across the lateral profile thereof. Its lowest point is generally at minimum 20. Length A, defined by the distance between minimum 20 and dotted line 32, may be approximately 3.5 centimeters. Maximums (or lobes) 16 and 18 have heights greater than minimum 20, but which also differ from one another. For example, distance B may be about 5.5 centimeters while distance C is closer to 7 centimeters. Distances B and C substantially comprise the distances between lobes 16 and 18 and dotted line 32, respectively (as illustrated in FIG. 1). Such differential measurements for distances B and C permit the orientation of pillow 10 to be reversed relative a given user, for providing variation in support offered by such pillow (as discussed further below with reference to FIG. 4).

As generally illustrated by FIG. 1, the diameter of arcuate ribs 22 is preferably smaller around minimum 20 than around maximums 16 and 18. Such diameters may vary over a range, such as 2–3 centimeters. The outer lateral edge portions of pillow 10 also have slopes which descend from lobes 16 and 18 respectively. The diameter of ribs 22 in such lateral edge regions also are preferably smaller than the diameter of ribs located at maximums 16 and 18, and smaller than those leading up to such maximums from central trough 20.

Figure 2:
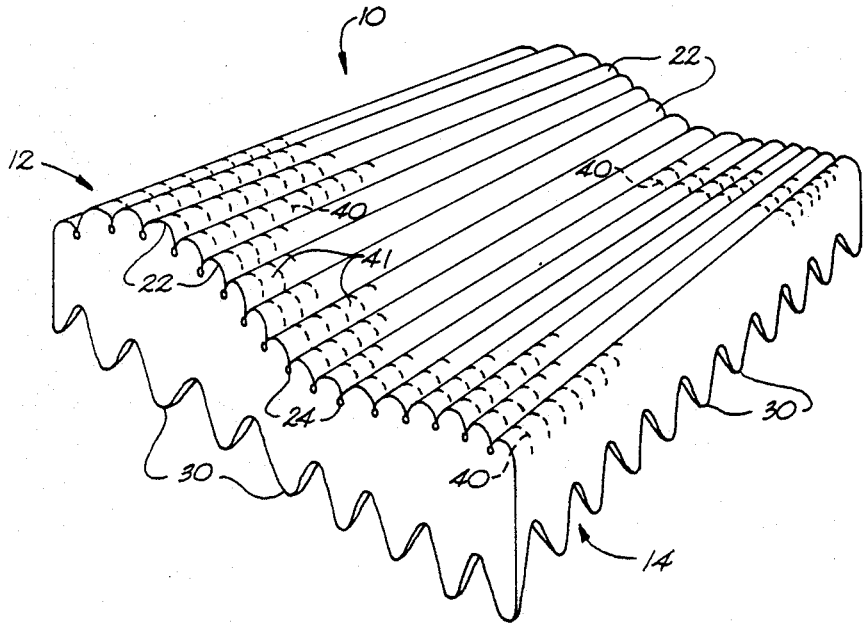
FIGS. 2 and 3 illustrate perspective views of the two main support surfaces (on opposite sides of the pillow) of the FIG. 1 embodiment.
Figure 3:
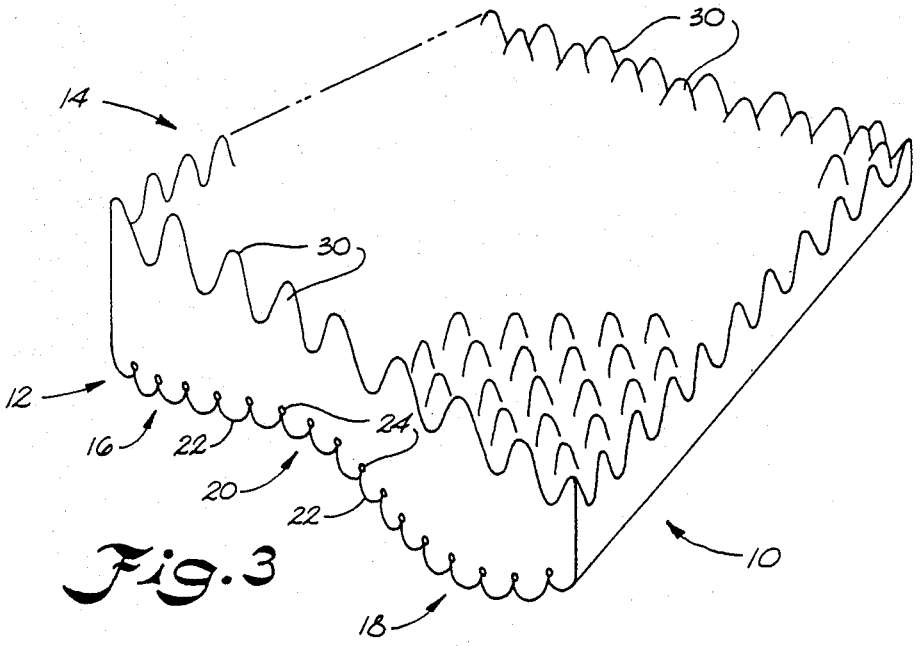

FIGS. 2 and 3 illustrate raised, perspective views of pillow 10 taken generally from a corner thereof. FIG. 2 illustrates curved surface 12 turned upward, and FIG. 3 illustrates a side inverted therefrom, with relatively flat profile, convoluted surface 14 disposed upwardly. Dotted line 32 is omitted from both FIGS. 2 and 3 to indicate that the entire exemplary pillow 10 illustrated therein constitutes a single integral member.

Both figures further illustrate the generally rectangular nature of pillow 10, discussed above in accordance with one set of exemplary measurements for such a pillow in conjunction with the embodiment of FIG. 1. FIG. 2 also illustrates the longitudinal nature of arcuate ribs 22, which run the full longitudinal length of pillow 10. Also, as understood from the foregoing discussion and the illustration of FIG. 1, channels 24 are formed the entire longitudinal length of pillow 10, alternately appearing between each rib thereof.

In addition to longitudinal features of this invention represented by ribs 22 and channels 24, FIG. 2 further illustrates optional lateral features concerning separations or cuts 40, formed in curved support surface 12. Such separations or cuts may extend to approximately the depth of the base of ribs 22. The purpose of such separations (when used) is to permit independent functionality (i.e. flexure and compression) for ribs 22 in the longitudinal sections 41 thereof defined between pairs of laterally-extending separations 40. Such cross-hatching effectively provides extra dispersion of pressure applied by a user to curved support surface 12. For clarity, separations 40 are illustrated only over a portion of curved support surface 12, but of course may extend to cover the entire surface (or any portion) thereof. Separations 40 may be provided at various intervals along the longitudinal length of ribs 22, such as 2–3 inches, or at even closer intervals if further dispersion of pressure is desired.

FIG. 3 illustrates an inverted view of the FIG. 2 embodiment, with relatively flat profile, convoluted support surface 14 turned upwardly for receipt and support of a user's head and neck. Again for clarity, only a portion of the projections 30 are illustrated which normally entirely cover support surface 14.

FIG. 3 (as well as FIG. 2) generally illustrates the differential height of prominent lobes 16 and 18 of the curved profile of curved support surface 12, as well as the presence of central trough 20. Because of the compression characteristics existent throughout foam pillow 10, support surface 14 when used in an upward support position will provide differential support to a user's head and neck supported thereon in a manner similar to that of surface 12 whenever it is turned upward, due to the predetermined, curved profile of surface 12 situated directly beneath surface 14. In other words, given a particular force applied at different points across support surface 14, the portion of surface 14 opposing relatively larger lobe 18 will be provided greater support than that part opposing lobe 16, which in turn is provided greater support than that part opposing central trough 20.

Figure 4:
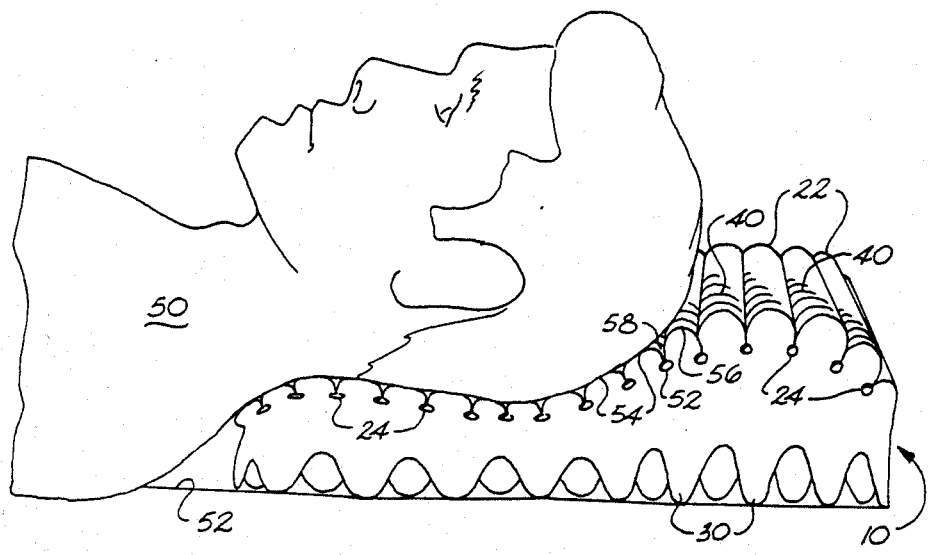
FIG. 4 is illustrates an end perspective view of an exemplary construction in one preferred manner of use thereof.

FIG. 4 illustrates one preferred use of a pillow 10 constructed in accordance with features of the present invention. As discussed above, it is desirable to provide differential support for a user's head and neck. Such head and neck support may be obtained by a user 50 reclining on pillow 10 in an orientation generally as illustrated in FIG. 4. The user's head rests chiefly in the central trough area 20 of curved support surface 12, with the user's neck being supported by one of lobes 16 or 18 of curved support surface 12. Both user 50 and pillow 10 may in turn be supported on a mattress 52 or the like.

While FIGS. 2 and 3 illustrate generally that pillow 10 of FIG. 4 may be inverted from the illustrated disposition thereof, pillow 10 of FIG. 4 may also or in the alternative be reversed so that an alternate lobe or maximum may be used to support the neck of user 50. The FIG. 4 embodiment is disposed substantially as the FIG. 1 illustration, with relatively lower lobe 16 shown on the left. Pillow 10 could be reversed so that relatively higher lobe 18 appeared on the left so as to support the neck of user 50 somewhat higher than as illustrated in present FIG. 4. Such reversal permits adaptation of pillow 10 to different sizes and shapes of different users' heads and necks, or to vary the amount of support for a given user's head and neck. Whether reversed or inverted, pillow 10 provides no particular restriction on lateral head or neck movement, and causes no unpleasant pressures or forces on the user.

Other beneficial features are particularly associated with the plurality of parallel, longitudinal ribs 22, and their related channels 24. It is generallY preferred that pillow 10 be used with a person's head and neck disposed perpendicularly to the longitudinal axis of the pillow (as shown in FIG. 4). In such orientation, a user's head and neck may undergo various lateral movements, and channels 24 remain perpendicular to the user to efficiently function as dissipation means for removing heat and moisture away from the user's head and neck.

As referred to above, either by diffusion through the foam material comprising pillow 10, or by separation of adjacent ribs which enhances radial openings along the longitudinal axis of channels 24, air is permitted to enter such channels. Such air may carry with it body heat and moisture which is naturally generated by a user. Longitudinal channels 24 then carry such air along their longitudinal length to disperse same from the user and discharge such air out axial end openings thereof. Such air may also emerge from radial openings along such longitudinal length at portions thereof removed from the user's head and neck, or similarly be diffused from channels 24 at portions thereof removed from the user.

With or without the presence of optional lateral separations 40 in ribs 22, the radial openings in channels 24 are enhanced at the periphery of a user's head and neck by independent functionality of ribs 22 resulting in differential compression and flexure of adjacent ribs 22. As illustrated in FIG. 4 with reference to particular channel 52, adjacent ribs 54 and 56 (which have relatively high differential force applied thereto by virtue of being located adjacent the periphery of the head of user 50) become separated at the "seam" of their adjoining diameters. Such seams are defined at circular edges of channel 52 meeting with adjacent diameters of ribs 54 and 56 (as illustrated by FIGS. 1 and 4). Separation of the contacting peripheral portions of adjacent ribs 54 and 56 expands radial opening 58 defined between such ribs. In other words, radial openings such as 58 may be formed by separating adjacent pairs of ribs along their mutual seams. Such opening and expansion further promotes the entry of air into channel 52, which heightens the dissipation function associated with such channels.

Enhanced radial openings 58 may be formed along virtually any pair of rib sections 41 located between separations 40 which are subjected to differential forces, such as those present near the periphery of a user's head. Due to the independent functioning of longitudinal rib sections 41 between separations 40, sections 41 not subjected to differential pressure (such as those within ribs 54 and 56 but longitudinally beyond the user's head) normally remain relatively closed so that air within channel 52 is further conducted in an axial direction away from the user. Such functioning maximizes the dissipation distance of such air from the user's head and neck. Heat and moisture is dissipated from the user by virtue of being contained within or carried by such air which is dissipated by the longitudinal channels.

While the dissipation means formed by such longitudinal channels may have an enhanced effect near the periphery of the user's head, as discussed above, it is to be understood that air (including heat and moisture) may enter any of the channels 24 adjacent a user's head and neck by virtue of diffusion through adjacent ribs 22 (or some degree of radial opening in channels 24), for dissipation along such channels.

Combination of the foregoing features provides a pillow which enables the user to select from a plurality of use orientations to maximize comfort and proper support for his or her needs and tastes, while including the dissipation function (and all various features thereof) disclosed above.

While one preferred exemplary embodiment of the present invention including a best mode thereof has been disclosed for present purposes, various modifications and variations thereto will occur to those of ordinary skill in the art, including substitution of equivalents for and reversal of various features and elements thereof. All such modifications and substitutions may be made without departing from the spirit and scope of this invention. For example, different dimensional characteristics may be used in contrast with those specifically disclosed above. Further, various types of foam materials may be used, including different materials with various or varying compression characteristics selected for particular applications. A given pillow need not be limited to the illustrated curvature for its curved support surface, and the cross-sections of ribs 22 and channels 24 need not be limited to those shown.

Also, alternate use orientations are included features of the present invention. For example, a user's head may be longitudinally received in central trough 20 of curved support surface 12, with lobes 16 and 18 received on either lateral side of the user's head. In such disposition, air channels 24 are in parallel with the person's head and neck, instead of being perpendicular thereto as illustrated in FIG. 4. However, even in such configuration, air channels 24 may perform the dissipation function described above. As a further variation, the presently disclosed pillow may be used with a loose fitting pillow slip, which due to such loose fitting would not affect any functions of the pillow itself as described above.

The foregoing specification is directed to exemplary preferred embodiments of the present invention and uses language intended for description and illustration only, and not as limitation, limiting language being set forth only in the appended claims.

What is claimed is:

1. A construction of resilient material for use as a head pillow for a person, comprising:

an integral member composed of said resilient material and having upper and lower support surfaces on opposite sides thereof, said lower support surface having a generally flat profile, and said upper support surface defining a predetermined profile the thickness of which varies relative said lower support surface, and includes at least two lobes and a trough therebetween;

a plurality of parallel, spherical ridge formed on generally most of said upper support surface and conforming to said profile thereof; and a plurality of parallel channels, defined by said upper support surface, and respectively interposed between adjacent of said ridges; wherein the radii of curvature of said ridges vary generally in accordance with the thickness of said predetermined profile of said upper support surface relative to said generally flat profile of said lower support surface, with relatively large radii of said ridges being associated with said lobes and relatively smaller radii of said ridges being associated with said trough.

2. A construction as in claim 1, wherein:

said lower support surface for said integral member includes said generally flat profile thereof defined by a plurality of convolutions formed thereon; and wherein said predetermined profile of said upper support surface includes a changing curvature of alternating relatively raised areas and low areas forming said lobes and said trough.

3. A construction as in claim 2, wherein one of said low areas is respectively disposed near each of respective edges of said predetermined profile and one of said low areas is near the center of said predetermined profile.

4. A construction as in claim 1, wherein:

said parallel channels have longitudinal radial openings defined by said parallel ridges respectively adjacent thereto, and axial openings at respective ends of said channels; whereby heat and moisture from a user's head supported on said construction enter portions of said radial openings adjacent the user's head, and is dissipated therefrom out said axial opening and portions of said longitudinal radial openings removed form the user's head.

5. A construction as in claim 1, wherein:

said lower support surface is covered by a plurality of convolutions defining said generally flat profile for said lower support surface; and wherein said pillow is adapted to receive a user's head adjacent said trough with such user's neck adjacent one of said lobes, whereby the relative elevation and position of such user's head and neck may be adjusted by selecting which one of said lobes is disposed adjacent the user's neck.

6. A construction as in claim 1, wherein said channels comprises dissipation means, operative associated with said upper support surface, for dissipating heat and moisture away from a user's head and neck when same are supported on said upper support surface.

7. A construction as in claim 6, wherein said channels include radial enntries thereto and axial exits therefrom, through which heat and moisture from a user's head and neck may enter and exit, respectively.

8. A construction as in claim 7, wherein:

said plurality of ridges are adapted for substantially independent compression and flexure responsive to receipt and support of a user's head and neck thereon, resulting in differential compression and flexure of an adjacent pair of said ridges near the periphery of a user's head supported thereon, which enhances radial entry of heat and moisture into the channel between such adjacent pair of ridges by widening the radial entry of such channel.

9. A construction as in claim 1, further comprising a plurality of lateral separations in said ridges for providing independent flexing of portions of said ridges longitudinally defined between adjacent of such lateral separations, thereby offering additional dispersion of pressure for a user's head or neck received thereon.

10. A construction as in claim 1, wherein:

said lower support surface includes a flat surface defined on said structure on a side thereof opposite said upper support surface; and said construction further includes an additive structure having generally the same composition and axes as said integral member, and including a flat surface adapted to be secured to said flat, lower support surface of sasid integral member and further including a convoluted surface disposed on a side opposite said flat surface of said additive structure; whereby, whenever said integral member and said additive structure are secured together at said flat surfaces thereof, only said upper support surface of said integral member and said convoluted surface of said additive structure are faced outward for operative receipt and support of a user's head and neck.

11. A pillow for supporting the head and neck of a person situated in a generally horizontal position, said pillow comprising:

a generally planar, rectangular body of resilient material, having two main support surfaces on opposing sides thereof and being invertible between two positions for providing direct support of the head and neck of a user on a selected one of said support surfaces of said body;

scalloping in rows, with spherical air channels defined therebetween, disposed on a given one of said support surfaces;

convolutions defined on another one of said support surfaces; wherein said convolutions of said another support surface define a substantially flat profile; and said scalloping of said given support surface defines a curved profile, the cross-section of which includes two maximums of differing heights and at least one minimum, situated between said maximums;

whereby, in either of said two invertible positions, said pillow is adapted for either said flat profile or said curved profile to support the head of a user substantially adjacent said minimum, and with the neck of such user substantially adjacent a selected one of said maximums, the selection of which determines the relative elevation and position of the user's head and neck; and further wherein said scalloping comprises a plurality of spherical ridges having diameters which vary across said curved profile, which diameters are generally larger adjacent said maximums than adjacent said minimum.

12. A pillow as in claim 11, wherein said rectangular body is approximately 40 centimeters wide by 52 centimeters along at said maximum said body is about 12 centimeters and 10.5 centimeters thick respectively, and about 8.5 centimeters thick at said minimum; and said spherical ridge diameters vary approximately in a range between 2 to 3 centimeters.

* * * * *